US009081319B2

(12) United States Patent
Suzuki et al.

(10) Patent No.: US 9,081,319 B2
(45) Date of Patent: Jul. 14, 2015

(54) ELECTROPHOTOGRAPHIC PHOTOCONDUCTOR, MANUFACTURING METHOD THEREOF, AND ELECTROPHOTOGRAPHIC DEVICE

(75) Inventors: Shinjirou Suzuki, Matsumoto (JP); Yoichi Nakamura, Matsumoto (JP); Ikuo Takaki, GuangDong (CN); Seizo Kitagawa, Matsumoto (JP); Kazuki Nebashi, Matsumoto (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 158 days.

(21) Appl. No.: 12/999,308

(22) PCT Filed: Dec. 14, 2009

(86) PCT No.: PCT/JP2009/070856

§ 371 (c)(1), (2), (4) Date: Mar. 17, 2011

(87) PCT Pub. No.: WO2010/071118

PCT Pub. Date: Jun. 24, 2010

(65) Prior Publication Data

US 2011/0244381 A1 Oct. 6, 2011

(30) Foreign Application Priority Data

Dec. 16, 2008 (JP) ..... 2008-320271

(51) Int. Cl.
*G03G 5/04* (2006.01)
*G03G 5/14* (2006.01)

(52) U.S. Cl.
CPC ..... *G03G 5/142* (2013.01); *G03G 5/144* (2013.01)

(58) Field of Classification Search
CPC ..... G03G 5/14; G03G 5/142; G03G 5/147; G03G 5/144
USPC ..... 430/60, 61, 62, 63
See application file for complete search history.

(56) References Cited

U.S. PATENT DOCUMENTS 2,297,691 A 10/1942 Carlson
4,345,066 A 8/1982 Ruter (Continued)

FOREIGN PATENT DOCUMENTS

JP 54-80580 6/1979
JP 56-45924 4/1981

(Continued)

*Primary Examiner* — Peter Vajda
*Assistant Examiner* — Olatunji Godo
(74) *Attorney, Agent, or Firm* — Rabin & Berdo, P.C.

(57) ABSTRACT

Provided is an electrophotographic photoconductor that has good coating solution stability and metal oxide dispersibility, is free of image defects including ground fogging and black spots, and affords good image characteristics in various environments, as well as a manufacturing method therefore and a device including the same. The electrophotographic photoconductor includes a conductive substrate; an undercoat layer; and a photosensitive layer. The undercoat layer contains, as a main component, a resin obtained by polymerizing, as starting materials, an aromatic dicarboxylic acid, at least one aliphatic dicarboxylic acid having 8 or more carbon atoms, and at least one diamine having a cycloalkane structure, and further contains a metal oxide. The aromatic dicarboxylic acid in the resin is present in an amount that ranges from 0.1 to 10 mol %, and the resin has an acid value and a base value that are each no greater than 10 KOH mg/g.

20 Claims, 3 Drawing Sheets

(56) References Cited

U.S. PATENT DOCUMENTS

| | | | | |
|---|---|---|---|---|
| 4,495,263 | A | 1/1985 | VanderValk | |
| 4,518,669 | A * | 5/1985 | Yashiki | 430/57.1 |
| 5,017,449 | A | 5/1991 | Yoshihara | |
| 5,071,723 | A * | 12/1991 | Koyama et al. | 430/59.6 |
| 5,173,385 | A | 12/1992 | Nozomi et al. | |
| 5,612,158 | A | 3/1997 | Iguchi et al. | |
| 5,972,550 | A | 10/1999 | Tamura et al. | |
| 2007/0154827 | A1 * | 7/2007 | Suzuki et al. | 430/60 |
| 2008/0138729 | A1 * | 6/2008 | Makino et al. | 430/64 |
| 2009/0162097 | A1 * | 6/2009 | Fuchigami | 399/159 |

FOREIGN PATENT DOCUMENTS

| | | | |
|---|---|---|---|
| JP | 60-501723 | T | 10/1985 |
| JP | 63-298251 | A | 12/1988 |
| JP | 02-193152 | A | 7/1990 |
| JP | 03-288157 | A | 12/1991 |
| JP | 04-031870 | A | 2/1992 |
| JP | 05-034964 | A | 2/1993 |
| JP | 05-289389 | A | 11/1993 |
| JP | 08-328283 | A | 12/1996 |
| JP | 09-166882 | A | 6/1997 |
| JP | 09-258469 | A | 10/1997 |
| JP | 2000-112164 | A | 4/2000 |
| JP | 2001-142315 | A | 5/2001 |
| JP | 2001-188376 | A | 7/2001 |
| JP | 2002-091044 | A | 3/2002 |
| JP | 2002-323781 | A | 11/2002 |
| JP | 2003-287914 | A | 10/2003 |
| JP | 2004-101699 | A | 4/2004 |
| JP | 2006-039022 | A | 2/2006 |
| JP | 2006-208474 | A | 8/2006 |
| JP | 2006-221157 | A | 8/2006 |
| JP | 2007-178660 | A | 7/2007 |
| WO | WO 2006054397 | * | 5/2006 |

* cited by examiner

ELECTROPHOTOGRAPHIC PHOTOCONDUCTOR, MANUFACTURING METHOD THEREOF, AND ELECTROPHOTOGRAPHIC DEVICE

BACKGROUND OF THE INVENTION

1. Field of the Invention

The present invention relates to an electrophotographic photoconductor (hereafter, also simply referred to as "photoconductor"), to a manufacturing method thereof, and to an electrophotographic device comprising the electrophotographic photoconductor. More particularly, the present invention relates to an electrophotographic photoconductor that is used in electrophotographic devices such as copiers, fax machines and printers, to a manufacturing method of the electrophotographic photoconductor, and to an electrophotographic device comprising the electrophotographic photoconductor.

2. Background of the Related Art

Image forming methods that rely on electrophotography are widely used in copiers, printers, plotters and digital multifunction machines that combine the functions of the foregoing, not only for office use, but also, in recent years, for personal use in the form of, for instance, small printers and fax machines. Many types of photoconductors for these electrophotographic devices have been developed since the invention by Carlson (Patent Document 1). Organic photoconductors (OPC) that employ organic materials are ordinarily used nowadays as photoconductors.

Known photoconductors include separate-function photoconductors, which are made up of a sequential stack of an undercoat layer that comprises a conductive substrate of aluminum or the like having an anodized film or a resin film thereon; a charge generation layer resulting from dispersing a photoconductive organic pigment, such as phthalocyanines or azo pigments, in a resin; a charge transport layer resulting from dispersing, in a resin, molecules having a partial structure that contributes to charge hopping conduction, such as amine or hydrazone molecules bonded to $\pi$ electron conjugated systems; and a protective layer, as the case may require. Other known photoconductors include, for instance, single layer-type photoconductors, wherein a single photosensitive layer, combining the functions of charge generation and charge transport, is provided on an undercoat layer, as the case may require.

For the sake of mass productivity, the above layers are ordinarily formed in accordance with a method wherein a pigment (charge generation material) having a charge generation or light scattering function, or a charge transport material having a charge transport function, are respectively dissolved or dispersed in an appropriate resin solution to yield a coating material in which a conductive substrate is then dipped.

In recent years, so-called digital devices have become mainstream electrophotographic devices. These devices, which use a monochromatic exposure light source in the form of, for instance, argon, helium-neon, a semiconductor laser or a light-emitting diode, digitalize information such as images and text, to convert the information into optical signals, on the basis of which light is irradiated into a charged photoconductor to form thereon an electrostatic latent image that is then made visible by way of toner.

Among charge generation materials, phthalocyanines exhibit greater light absorption at the oscillation wavelength range of semiconductor lasers (780 nm), as compared with other charge generation materials, and exhibit likewise excellent charge generation ability. As a result, phthalocyanines are widely used as a material for photosensitive layers. Known current photoconductors employ various phthalocyanines having a central metal of copper, aluminum, indium, vanadium, or titanium.

Photoconductor charging methods include, for instance, contactless charging methods in which a charging member such as a scorotron does not come into contact with the photoconductor, and contact charging methods in which a charging member that uses a semiconductive rubber roller or brush comes into contact with the photoconductor. Contact charging methods are advantageous, as compared with contactless charging methods, in that corona discharge takes place very close to the photoconductor. As a result, little ozone is generated, and the applied voltage may be lower. Therefore, contact charging methods allow realizing electrophotographic devices that are more compact, less expensive and environmentally less polluting, for which reason they have become the mainstream charging method in medium to small devices.

Means for cleaning the photoconductor surface involve mainly, for instance, plate scraping or cleaning simultaneous with developing. In plate cleaning, untransfered residual toner of the surface of the surface of the organic photoconductor is scraped by a plate, and the toner is recovered into a waste toner box or is returned to the developing device. Cleaners that employ plate scraping need space for a recovery box for recovered toner, and/or space for recycling. Also, the filling state of the toner recovery box must be monitored. The life of the electrophotographic photoconductor may be shortened through damage of the surface of the organic photoconductor when paper dust or external additive remains on the plate. Therefore, the developing process may be accompanied by toner recovery, or by a process of adsorbing, magnetically or electrically, residual toner adhered to the surface of the electrophotographic photoconductor, immediately in front of the developing roller. In order to increase toner transfer efficiency in the transfer step, control is performed so as to optimize the transfer current in accordance with the temperature and humidity of the environment and in accordance with paper characteristics. Better transfer efficiency results in less residual toner. Organic photoconductors suitable for the above-described processes and contact charging must have improved toner releasability (Patent Document 2) and/or exhibit little transfer influence.

In reverse development processes, dark potential corresponds to white paper portions on the image, while bright potential corresponds to text portions. Therefore, the presence of structural defects on the substrate, such as significant unevenness, or defects derived from substance inhomogeneity, on account of impurities or the like, is visualized in the form of image defects such as ground fogging or black spots on white paper portions. Defective images are thought to occur on account of injection of charge from the conductive substrate into the photosensitive layer, caused by defects in the conductive substrate, since these charge injections give rise to local drops in charging potential at defect sites. In electrophotographic devices that employ simultaneously a reverse developing method and a contact charging method, in particular, direct contact between the photoconductor and the charging member may result in charge leakage. Such electrophotographic devices are highly prone to suffering the above problem. Also, color machines have been gaining in popularity in recent years. Color machines, however, have often a high transfer current setting, and are therefore likelier to exhibit undesirable charge leakage during transfer.

An ordinary way of improving on the problems of such electrophotographic devices is to provide an undercoat layer between the conductive substrate and the photosensitive layer. The undercoat layer uses an aluminum anodized film, a boehmite film, or a resin film of, for instance, polyvinyl alcohol, casein, polyvinyl pyrrolidone, polyacrylic acid, gelatin, polyurethane, polyamide or the like. For instance, Patent Document 3 discloses a photoconductor using an anodized film in an undercoat layer. Patent Documents 4 to 6 disclose photoconductors having undercoat layers that comprise specific nylon types. These undercoat layers, however, suffer from a problem to be solved, namely image defects caused by interference fringes derived from reflection of exposure light by the substrate.

Copolymer nylon films are obtained as uniform films by dip coating, are excellent for mass production and are inexpensive, for which reasons they are widely employed. For instance, Patent Document 7 discloses the feature of using caprolactam as a constituent monomer of a copolymer nylon resin in a photoconductor for rear-face exposure. Also, Patent Document 8 indicates that an undercoat layer comprising a nylon resin having a specific copolymer composition affords excellent charging and residual potential characteristics. Patent Document 9 indicates that a photoconductor coating solution comprising a copolymer polyamide resin having a specific diamine component is effective for enhancing coatability and storage stability. The electric characteristics of the above undercoat layers vary significantly depending on the use environment, and give rise to problems of ground fogging in the image due to fluctuations in electric resistance caused by moisture absorption by the undercoat layer, in particular in high-temperature high-humidity environments. A further problem in low-temperature low-humidity environments is the occurrence of exposure memory on the image caused by charge traps in the film on account of lower density or higher resistance in the undercoat layer, as a result of an increased bright potential, owing to a significant increase in resin resistivity.

To counteract the occurrence the above image problems, it has been proposed to prevent the appearance of image defects, caused by interference fringes, by suppressing excessive reflection of exposure light by the substrate, and to use, as the undercoat layer, a layer in which metal oxide particles, such as titanium oxide, zinc oxide or the like, are dispersed in a resin, with a view to appropriately adjusting the resistance value of the undercoat layer. For instance, Patent Document 10 discloses the feature of using a resin layer containing titanium oxide in an interlayer, with a view to curbing environmental dependence. Patent Document 11 indicates that moisture resistance can be enhanced by using a polyamide resin having a specific structure, in an interlayer. Patent Document 12 discloses a photoconductor comprising an azo pigment and a copolymer polyamide resin having a diamine component of specific structure. Patent Document 13 discloses a photoconductor that uses a polyamide resin obtained by condensation of polymer fatty acids and diamines.

Other factors that lead to image defects such as ground fogging and black spots on a white background include, for instance, formation of aggregates of the metal oxide that is used in the undercoat layer. When present in the coating solution, such aggregates become charge paths in the film upon application of the coating solution. These charge paths give rise in turn to micro-leaks of charge on the photosensitive layer surface, that result in image defects similar to those caused by ground defects. Patent Document 14 indicates that scumming caused by long-term use can be curtailed by using a photoconductor that employs a metal oxide, a specific copolymer and a phthalocyanine pigment.

Patent Document 15 discloses a photoconductor in which an undercoat layer uses a polyamide resin containing an aromatic dicarboxylic acid monomer, as a photoconductor having good him characteristics and good metal oxide dispersibility, in order to improve environment dependence.

Patent Document 1: U.S. Pat. No. 2,297,691

Patent Document 2: Japanese Patent Application Laid-open No. 2006-39022

Patent Document 3: Japanese Patent Application Laid-open No. 2002-323781

Patent Document 4: Japanese Patent Application Laid-open No. H5-34964

Patent Document 5: Japanese Patent Application Laid-open No. H2-193152

Patent Document 6: Japanese Patent Application Laid-open No. H3-288157

Patent Document 7: Japanese Patent Application Laid-open No. S60-501723

Patent Document 8: Japanese Patent Application Laid-open No. H8-328283

Patent Document 9: Japanese Patent Application Laid-open No. H4-31870

Patent Document 10: Japanese Patent Application Laid-open No. S63-298251

Patent Document 11: Japanese Patent Application Laid-open No. 2003-287914

Patent Document 12: Japanese Patent Application Laid-open No. 2006-208474

Patent Document 13: Japanese Patent Application Laid-open No. 2006-221157

Patent Document 14: Japanese Patent Application Laid-open No. 2007-178660

Patent Document 15: Japanese Patent Application Laid-open No. 2004-101699

However, Patent Document 10 discloses only an example of a nylon resin having a specific structure. Patent Document 11 does not mention any aromatic ring in the dicarboxylic structure of the constituent monomers, and does delve sufficiently into the effect that is elicited by adding an aromatic dicarboxylic acid as a monomer.

Patent Document 12 discloses a photoconductor comprising an azo pigment and a copolymer polyamide resin having a diamine component of specific structure, but does not disclose the effect of the structure on the transfer history of the polyamide resin. Patent Document 13, which discloses a photoconductor that uses a polyamide resin obtained by condensation of a polymer fatty acid and a diamine, is problematic as regards fluctuation in the properties of the undercoat layer caused by oxidation of unsaturated fatty acids in the coating solution.

Patent Document 14 indicates that scumming caused by long-term use can be curtailed by using a photoconductor that employs a metal oxide, a specific copolymer and a phthalocyanine pigment. Although the polymer resin disclosed in Patent Document 14 can inhibit the generation of secondary aggregates, there is missing a thorough appraisal on potential fluctuations caused by transfer influence in devices having high transfer currents, such as color machines.

Patent Document 15, which proposed a photoconductor in which a polyamide resin containing aromatic dicarboxylic acid monomers is used in an undercoat layer, was problematic as regards the occurrence, when such an undercoat layer is employed, of uneven density in the image, on account of the influence on transferability of a high-transfer current process, as is the case in four-cycle color machines.

Conventional photoconductors, therefore, failed to avoid the problem of image defects in the form of memory or density changes in transfer sites in a subsequent process, and which arose from accumulation of reverse-polarity space charge in the photosensitive layer, and from the resulting negative influence on charging characteristics upon a subsequent rotation process, in cases of high transfer current settings, as found in color machines.

In the light of the above, thus, it is an object of the present invention to provide an electrophotographic photoconductor having good coating solution stability and good metal oxide dispersibility that is free of image defects such as ground fogging and black spots on a white background, and that affords good image characteristics in various environments.

A further object of the present invention is to provide an electrophotographic photoconductor having good image gradation properties and color reproducibility, in particular in color machines.

A further object of the present invention is to provide an electrophotographic photoconductor that affords good image quality stably, i.e. an electrophotographic photoconductor that affords high image homogeneity and in is free of transfer history in the form of image memory, by precluding potential fluctuations on account of transfer influence, also in devices having high transfer current, such as color machines.

Yet another object of the present invention is to provide a method for manufacturing the above electrophotographic photoconductor and to provide an electrophotographic device comprising the electrophotographic photoconductor.

SUMMARY OF THE INVENTION

As a result of diligent research directed at solving the above problems, the inventors perfected the present invention upon finding that the problems can be solved by using a polyamide resin synthesized from specific starting materials, and by controlling the acid value and base value thereof so as to lie within appropriate ranges, by using an undercoat layer in which a metal oxide is dispersed in the polyamide resin. Specifically, the inventors perfected the present invention upon finding that there could be achieved an electrophotographic photoconductor having good environment characteristics, good image gradation properties and color reproducibility in color machines, good metal oxide dispersibility, and being free of image defects such as ground fogging and black spots on a white background. Further, the inventors perfected the present invention upon finding that there could be achieved an electrophotographic photoconductor that affords high image homogeneity and is free of transfer history in the form of image memory, by precluding potential fluctuation on account of transfer influence, also in devices having high transfer current, such as color machines.

Specifically, the electrophotographic photoconductor of the present invention comprises a conductive substrate; an undercoat layer provided on the conductive substrate; and a photosensitive layer provided on the undercoat layer so that a sequential stack is obtained, wherein said undercoat layer contains, as a main component, a resin obtained by polymerizing, as starting materials, an aromatic dicarboxylic acid, at least one type of aliphatic dicarboxylic acid having 8 or more carbon atoms, and at least one type of diamine having a cycloalkane structure, and further contains a metal oxide, and wherein said aromatic dicarboxylic acid is present in said resin in an amount that ranges from 0.1 to 10 mol %, and said resin has an acid value and a base value that are each no greater than 10 KOH mg/g.

In the present invention, preferably, the resin is obtained through mixing and polymerization so as to satisfy formula (1) that follows:

$$-2.0 \text{ mol } \% \leq A - B \leq 2.0 \text{ mol } \% \quad (1),$$

where A mol % denotes the sum of the aromatic dicarboxylic acid and one, two or more types of the aliphatic dicarboxylic acid having 8 or more carbon atoms, and B mol % denotes the sum of one, two or more types of the diamine having a cycloalkane structure.

The aromatic dicarboxylic acid preferably has a structure represented by general formula (2) that follows:

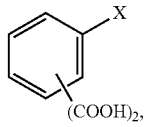

(2)

where X denotes a hydrogen atom, an alkyl group, an allyl group, a halogen atom, an alkoxy group or an aryl group.

Another electrophotographic photoconductor of the present invention comprises a conductive substrate; an undercoat layer provided on the conductive substrate; and a photosensitive layer provided on the undercoat layer so that a sequential stack is obtained, wherein said undercoat layer contains, as a main component, a resin obtained by polymerizing, as starting materials, an aromatic dicarboxylic acid, one type of aliphatic dicarboxylic acid having 8 or more carbon atoms, and one type of diamine having a cycloalkane structure, and further contains a metal oxide, and wherein said aromatic dicarboxylic acid is present in said resin in an amount that ranges from 0.1 to 10 mol %, and said resin has an acid value and a base value that are each no greater than 10 KOH mg/g.

The method for manufacturing the electrophotographic photoconductor of the present invention is a method for manufacturing the above-described electrophotographic photoconductor, and comprises a step of forming an undercoat layer by applying a coating solution for undercoat layers on a conductive substrate. The coating solution contains, as a main component, a resin obtained by polymerizing, as starting materials, an aromatic dicarboxylic acid, at least one type of aliphatic dicarboxylic acid having 8 or more carbon atoms, and at least one type of diamine having a cycloalkane structure, and further contains a metal oxide. The aromatic dicarboxylic acid is present in the resin in an amount that ranges from 0.1 to 10 mol %, and the resin has an acid value and a base value that are each no greater than 10 KOH mg/g.

An electrophotographic device of the present invention comprises the above electrophotographic photoconductor. The electrophotographic device may be a color printer.

By virtue of the above features, the present invention allows realizing an electrophotographic photoconductor having very high dispersion stability in a coating solution and that exhibits small drops in density, caused by rises in potential at bright portions, in low-temperature low-humidity environments, thanks to the metal oxide that is dispersed in the undercoat layer. By suppressing the formation of metal oxide secondary aggregates in the undercoat layer, the present invention affords an electrophotographic photoconductor that is free of image defects such as ground fogging and black spots on white paper, caused by the above secondary aggregates. Using such an undercoat layer should result in enhanced hole transport performance in the undercoat layer, and in less hole trapping derived from the undercoat layer, in cases of fluctuation of the transfer potential at high voltage, so that the drop in charging surface potential can be reduced in a subsequent process. Therefore, an electrophotographic device provided with the electrophotographic photoconductor of the present invention affords good images, with no memory and no drops in density, not only in ordinary usage environments but also in low-temperature low-humidity environments, the images being free of black spots, ground fogging or the like even in high-temperature high-humidity environments. The present invention affords also a photoconductor free of image defects caused by transfer influence, also in high transfer current devices, such as color machines.

The invention elicits a sufficient effect in terms of, for instance, potential fluctuation on account of transfer influence in high transfer current devices, such as color machines, through suppression of the formation of secondary aggregates by modifying constituent monomers vis-à-vis those of the resin set forth in Patent Document 14.

DETAILED DESCRIPTION OF THE INVENTION

Preferred embodiments of the electrophotographic photoconductor of the present invention are explained in detail below.

Figure 1:
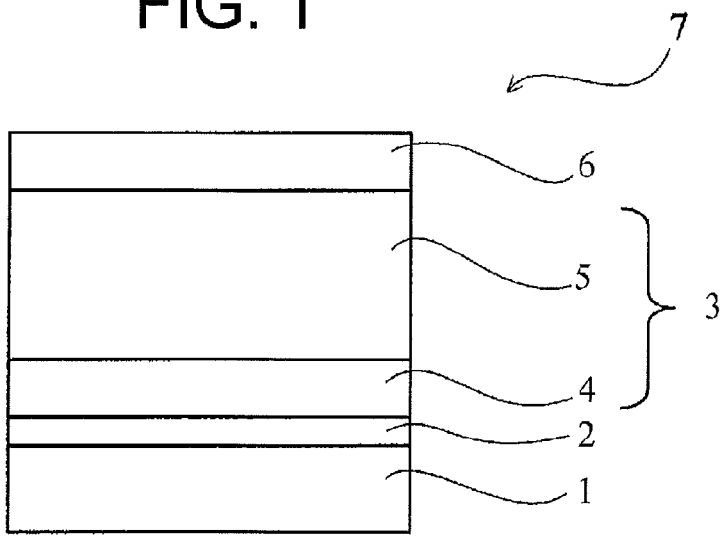
FIG. 1 is a schematic cross-sectional diagram illustrating an example of the configuration of a negatively chargeable separate-function stacked electrophotographic photoconductor according to the present invention.

The electrophotographic photoconductor may be a negatively-chargeable stacked photoconductor or a positively-chargeable single layer-type photoconductor. The example illustrated in the schematic cross-sectional diagram of FIG. 1 corresponds to a negatively-chargeable stacked electrophotographic photoconductor. As illustrated in the figure, an electrophotographic photoconductor 7 of the present invention, in the form of a negatively-chargeable stacked photoconductor, comprises a conductive substrate 1, and sequentially stacked thereon, an undercoat layer 2, and a photosensitive layer 3 that comprises a charge generation layer 4 having a charge generation function and a charge transport layer 5 having a and charge transport function. Regardless of the type of the photoconductor 7, a surface protective layer 6 may be further provided on top of the photosensitive layer 3. The photosensitive layer 3 illustrated in FIG. 1 is of function-divided stacked type, comprising the charge generation layer 4 and the charge transport layer 5, although the photosensitive layer 3 may also be configured in the form of a single layer-type comprising a single photosensitive layer.

The undercoat layer 2 in the photoconductor 7 of the present invention comprises, as a main component, a resin obtained by polymerizing 0.1 to 10 mol % of an aromatic dicarboxylic acid, one, two or more types of aliphatic dicarboxylic acid having 8 or more carbon atoms; and one, two or more types of diamine having a cycloalkane structure, and further contains a metal oxide. The acid value and base value of the resin are both no greater than 10 KOH mg/g. The denominator in the content of the respective components of the resin starting material of the present invention is the sum total of the resin starting materials.

The polymer reaction in the present invention is a dehydration condensation reaction between carboxylic acids and amines. Theoretically, formation a polymer comprising one molecule, through reaction of all starting materials, results in a lowest limit of acid value and base value substantially close to 0. To achieve the undercoat layer 2, the molecular weight of the obtained resin must be such a molecular weight as to impart solvent solubility to the resin. Such being the case, the obtained acid value and base value are greater than the above lowest-limit acid value and base value. To elicit solvent solubility, the acid value and base value in the present invention need only be no greater than 10.0 KOH mg/g, and thus no particular lower limit is imposed on the acid value and base value.

In the present invention, the number of moles of aromatic dicarboxylic acid in the resin used in the undercoat layer 2 ranges from 0.1 to 10 mol %. Preferably, the resin is obtained through mixing and polymerization so as to satisfy formula (1) below:

$$-2.0\text{ mol }\% \leq A-B \leq 2.0\text{ mol }\% \quad (1),$$

where A mol % denotes the sum of aromatic dicarboxylic acid, and one, two or more types of aliphatic dicarboxylic acid having 8 or more carbon atoms, and B mol % denotes the sum of one, two or more types of diamine having a cycloalkane structure.

In the present invention, preferably, the resin used in the undercoat layer 2 can be obtained through mixing and polymerization so as to satisfy formula (1) below:

$$-2.0\text{ mol }\% \leq A-B \leq 2.0\text{ mol }\% \quad (1),$$

where A mol % denotes the sum of aromatic dicarboxylic acid, and one type of aliphatic dicarboxylic acid having 8 or more carbon atoms, and B mol % denotes the sum of one type of diamine having a cycloalkane structure.

The amount of aromatic dicarboxylic acid in the resin starting material must range from 0.1 to 10 mol %, preferably from 2 to 8 mol %. A small amount of aromatic dicarboxylic acid results in a more hygroscopic resin, which translates into larger environment-derived fluctuations of the electric characteristics of the photoconductor 7. This gives rise, in turn, to fogging and black spot defects in high-temperature high-humidity environments. On the other hand, dispersibility is impaired when the amount of aromatic dicarboxylic acid exceeds 10 mol %.

The aromatic dicarboxylic acid used in the present invention is preferably a compound having a structure represented by general formula (2) below:

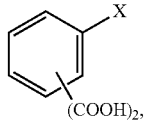

(2)

where X denotes a hydrogen atom, an alkyl group, an allyl group, a halogen atom, an alkoxy group, an aryl group or an alkylene group). Specifically, the aromatic dicarboxylic acid is phthalic acid, isophthalic acid or terephthalic acid, and X is an alkyl group, an allyl group, a halogen atom, an aryl group or an alkylene group. Preferred among the foregoing are isophthalic acid, phthalic acid, terephthalic acid, isophthalic acid or fluorides, chlorides or bromides thereof.

In the present invention, the one, two or more types of aliphatic dicarboxylic acid having 8 or more carbon atoms may be an aliphatic dicarboxylic acid such as, for instance, any one from among dodecanedioic acid, undecanedioic acid, sebacic acid and tridecanedioic acid, either singly or in combination. Preferred among the foregoing is dodecanedioic acid.

The one, two or more types of diamine having a cycloalkane structure in the present invention may be, for instance, 5-amino-1,3,3-trimethylcyclohexane methylamine (also referred to as isophorone diamine), 1,2-diaminocyclohexane, 1,3-diaminocyclohexane, 1,4-diaminocyclohexane, decahydronaphthalene-2,6-diamine or decahydronaphthalene-2,7-diamine. Isophorone diamine is particularly preferred among the foregoing.

Examples of polymerization of resins using these starting materials are explained below.

Firstly, the starting materials are mixed in suitable proportions that satisfy formula (1) above, and a condensation polymerization reaction is carried out in a reaction system under a nitrogen gas stream, at normal pressure and with heating up to a temperature ranging from 200 to 350° C. Then, the pressure is reduced and the reaction is continued at the same temperature for several additional hours. The acid value and the base value of the obtained resin are measured by titration, to verify that both the acid value and the base value are not greater than 10.0 KOH mg/g. The reaction is allowed to continue when either one or both of the acid value and the base value are greater than 10.0 KOH mg/g, since good dispersibility cannot be achieved in that case. $H^1$-NMR and $C^{13}$-NMR measurements of the obtained resin allow checking whether the target copolymer is produced according to the proportion of starting materials.

The metal oxide used in the invention can be selected from simple or complex metal oxides of titanium oxide, zinc oxide, tin oxide, zirconium oxide, silicon oxide, copper oxide, magnesium oxide, antimony oxide, vanadium oxide, yttrium oxide and niobium oxide, singly or in combination. The metal oxide may be subjected to a surface treatment to enhance the dispersibility thereof. In the surface treatment there can be appropriately used, for instance, an organosilane coupling agent, and there can also be used, for instance, one or more organic compounds selected from the group consisting of siloxane compounds, alkoxysilane compounds and silane coupling agents.

The metal oxide preferably exhibits an acid value and a base value none of which is no greater than 20.0 KOH mg/g. If the acid value or the base value of the metal oxide dispersed in the undercoat layer 2 is greater than 20 KOH mg/g, dispersibility in the resin of the undercoat layer may deteriorate, resulting in poor images. More preferably, when the acid value of the undercoat layer resin is higher than the base value of the undercoat layer resin, the base value of the metal oxide used in combination is higher than the acid value of the metal oxide. When the base value of the undercoat layer resin is higher than the acid value of the undercoat layer resin, the acid value of the metal oxide used in combination is preferably higher than the base value of the metal oxide. The above mutual relationship in terms of acid-base interactions between the undercoat layer resin and the metal oxide results in better dispersion stability, and is thus preferable.

To measure the acid value of the metal oxide, a sample is added to a butyl amine-methanol solution of known concentration, followed by ultrasonic dispersion for 1 hour. The supernatant after centrifugation is then titrated. Simultaneously, a blank test is conducted and the amount of consumed butyl amine is notated in KOH mg/g (consumed amount in terms of mg of KOH per 1 g). The base value is measured by adding a sample into an acetic acid-methanol solution of known concentration, followed by ultrasonic dispersion for 1 hour. The supernatant after centrifugation is then titrated. Simultaneously, a blank test is conducted and the amount of consumed acetic acid is notated in KOH mg/g (consumed amount of acid in terms of mg of KOH per 1 g).

Preferably, the ratio between metal oxide and resin binder in the coating solution is adjusted in such a manner that the ratio of resin binder with respect to 100 parts by weight of solids fraction in the undercoat layer 2 ranges from 5 to 80 parts by weight after application and drying. A particularly preferred composition includes 95 to 40 parts by weight of metal oxide, and 5 to 60 parts by weight of resin binder, and yet more preferably 90 to 70 parts by weight of metal oxide and 10 to 30 parts by weight of resin binder, relative to 100 parts by weight of solids fraction of undercoat layer. The resin of the present invention may be used singly, but also in combination with other resins, as the case may require, in amounts that are not problematic in terms of photoconductor characteristics and coating solution dispersibility. Such other resins that can be mixed with the resin binder include, for instance, polyamide resins, polyester resins, polyurethane resins, melamine resins, epoxy resins, polyvinyl acetal resins, polyvinyl butyral resins, phenoxy resins, silicone resins, polyvinyl chloride resins, polyvinylidene chloride resins, polyvinyl acetate resins, cellulose resins and the like. The effect of the present invention can be achieved when the amounts of resins in the mixture are 100 to 50 parts by weight of the resin of the present invention, and 0 to 50 parts by weight of other above-described resins, with respect to 100 parts by weight of resin.

Preferably, the thickness of the undercoat layer 2 ranges from 0.1 to 10 μm, more preferably from 0.3 to 5 μm, and yet more preferably from 0.5 to 3.0 μm.

So long as the undercoat layer 2 satisfies the above conditions, the photoconductor 7 of the present invention is not particularly limited as regards other layers that may be provided therein and which can be appropriately selected in accordance with known methods. The configuration of the photosensitive layer 3 may be of separate-function stacked type, comprising the charge generation layer 4 and charge transport layer 5 as described above, or may be of single layer-type, comprising a single photosensitive layer. An explanation follows next on the various layers in a separate-function stacked type electrophotographic photoconductor.

As the conductive substrate 1 there can be used, for instance, a cylinder made of metal, for instance aluminum, or a conductive plastic film. The conductive substrate 1 may also be glass, or a molded body or sheet material of polyamide, polyethylene terephthalate or the like, provided with electrodes.

The charge generation layer 4 can be formed using various organic pigments, as the charge generation material, together with the resin binder. Particularly preferred charge generation materials include, for instance, metal-free phthalocyanines having various crystal forms, various phthalocyanines having a central metal such as copper, aluminum, indium, vanadium, titanium or the like, as well as various bisazo pigments and trisazo pigments. The particle size of the organic pigment, which is in a dispersed state in the resin binder, is adjusted to range from 50 to 800 nm, more preferably from 150 to 500 nm.

The characteristics of the charge generation layer 4 are affected by the resin binder. The resin binder in the present invention is not particularly limited, and can be appropriately selected from among polyvinyl chloride resins, polyvinyl butyral resins, polyvinyl acetal resins polyester resins, polycarbonate resins, acrylic resins, phenoxy resins and the like. The thickness of the charge generation layer 4 ranges from 0.1 to 5 μm, preferably, in particular, from 0.2 to 0.5 μm.

The selection of coating solution solvent is important in terms of obtaining a good dispersion state and forming a uniform charge generation layer 4. In the present invention there can be used, for instance, aliphatic halogenated hydrocarbons such as methylene chloride, 1,2-dichloroethane or the like; ether hydrocarbons such as tetrahydrofuran; ketones such as acetone, methyl ethyl ketone, cyclohexanone or the like; and esters such as ethyl acetate, ethyl cellosolve or the like. Preferably, the ratio between charge generation material and resin binder in the coating solution is adjusted in such a manner that the ratio of resin binder ranges from 20 to 80 parts by weigh tin the charge generation layer 4 after application and drying. A particularly preferred composition of the charge generation layer 4 includes 60 to 40 parts by weight of charge generation material with respect to 40 to 60 parts by weight of resin binder.

To apply and form the charge generation layer 4, a coating solution is prepared by suitably blending the above-described composition, and by treating the resulting coating solution in a dispersing device such as a sand mill, a paint shaker or the like, to adjust thereby the organic pigment particles to the above-described desired particle size that is amenable for coating.

The charge transport layer 5 can be formed by dissolving the charge transport material, singly or together with a resin binder, in a suitable solvent, to prepare thereby a coating solution. The resulting coating solution is then coated, for instance by dipping or using an applicator, onto the charge generation layer 4, followed by drying. As the charge transport material there is suitably used a substance having hole transport characteristics or electron transport characteristics, depending on the charging method of the photoconductor 7 in the multifunction machine, printer, fax machine or the like. The above substances can be appropriately selected from among known charge transport substances (for instance, as described in P. M. Borsenberger and D. S. Weiss eds., "Organic Photoreceptors for Imaging Systems", Marcel Dekker Inc., 1993). Hole transport materials include hydrazone compounds, styryl compounds, diamine compounds, butadiene compounds, enamine compounds, indole compounds as well as mixtures of these. Electron transport materials include benzoquinone derivatives, phenanthrenequinone derivatives, stylbenequinone derivatives, azoquinone derivatives and the like.

In terms of film strength and wear resistance, polycarbonate polymers are widely used as the resin binder that forms the charge transport layer 5 together with the charge transport material. Such polycarbonate polymers include bisphenol A, bisphenol C, bisphenol Z types, and copolymers comprising monomer units that make up these bisphenols. The molecular weight of the polycarbonate polymer ranges optimally from 10,000 to 100,000. In addition to the polycarbonate, the binder resin used may also be polyethylene, polyphenylene ether, an acrylic resin, polyester, polyamide, polyurethane, an epoxy resin, polyvinyl acetal, polyvinyl butyral, a phenoxy resin, a silicone resin, polyvinyl chloride, polyvinylidene chloride, polyvinyl acetate, a cellulose resin, and copolymers of these.

In terms of, for instance, charge characteristics and wear resistance of the photoconductor 7, the thickness of the charge transport layer 5 ranges preferably from 3 to 50 μm. Silicone oil may be optionally added to the charge transport layer, with a view to achieving a smoother surface. A surface protective layer 6 may be further formed on the charge transport layer 5, as the case may require.

A single layer-type photosensitive layer comprises mainly a charge generation material, a hole transport material, an electron transport material (acceptor compound) and a resin binder. Various organic pigments can be used as the charge generation material, as in the case of the stacked type. Particularly preferred charge generation materials include, for instance, metal-free phthalocyanines having various crystal forms, various phthalocyanines having a central metal such as copper, aluminum, indium, vanadium, titanium or the like, as well as various bisazo pigments and trisazo pigments.

Hole transport substances include hydrazone compounds, styryl compounds, diamine compounds, butadiene compounds, indole compounds as well as mixtures of these. Electron transport materials include benzoquinone derivatives, phenanthrenequinone derivatives, stylbenequinone derivatives, azoquinone derivatives and the like. These compounds can be used singly or in combinations of two or more.

Examples of the resin binder that is used include, for instance, a polycarbonate resin by itself, or suitably combined with a polyester resin, a polyvinyl acetal resin, a polyvinyl butyral resin, a polyvinyl alcohol resin, a vinyl chloride resin, a vinyl acetate resin, a polyethylene resin, a polypropylene resin, a polystyrene resin, an acrylic resin, a polyurethane resin, an epoxy resin, a melamine resin, a silicone resin, a polyamide resin, a polystyrene resin, a polyacetal resin, a polyarylate resin, a polysulfone resin, and a polymer of methacrylic acid esters and copolymers thereof. There may also be used mixtures of resins of the same type but dissimilar molecular weight.

The thickness of the single layer-type photosensitive layer ranges preferably from 3 to 100 μm, more preferably from 10 to 50 μm, in order to preserve an effective surface potential in practice. Silicone oil may be optionally added to the photosensitive layer, with a view to achieving a smoother surface. A surface protective layer 6 may be further formed on the photosensitive layer, as the case may require.

The method for manufacturing the electrophotographic photoconductor 7 of the present invention is a method for manufacturing the above-described electrophotographic photoconductor 7 of the present invention. The method for manufacturing the electrophotographic photoconductor 7 of the present invention comprises a step of forming the undercoat layer 2 by applying a coating solution for the undercoat layer 2 onto the conductive substrate 1. The coating solution comprises, as a main component, a resin obtained by polymerizing an aromatic dicarboxylic acid, one, two or more types of aliphatic dicarboxylic acid having 8 or more carbon atoms, and one, two or more types of diamine having a cycloalkane structure, and further contains a metal oxide. The aromatic dicarboxylic acid takes up 0.1 to 10 mol % of the resin. The acid value and base value of the polymerized resin are both no greater than 10 KOH Gmg/g. For instance, the undercoat layer 2, formed by dip coating of the above coating solution, is formed on the conductive substrate 1. The charge generation layer 4 is formed onto the undercoat layer 2 by dip coating of a coating solution of resin binder having dispersed therein the above charge generation material. A negatively chargeable photoconductor 7 can then be manufactured by further overlaying thereon the charge transport layer 5, which is formed by dip coating of a coating solution in which the above-described charge transport material is dispersed or dissolved in a resin binder.

The electrophotographic photoconductor 7 of the present invention elicits the anticipated effect when used in various machine processes. Specifically, the effect of the electrophotographic photoconductor 7 is fully brought out in charging processes such as contact charging using rollers, brushes or the like, or contactless charging using corotrons, scorotrons or the like, as well as in developing processes such as contact developing and contactless developing using, for instance, non-magnetic one-component development, or magnetic one-component or two-component development.

Figure 2:
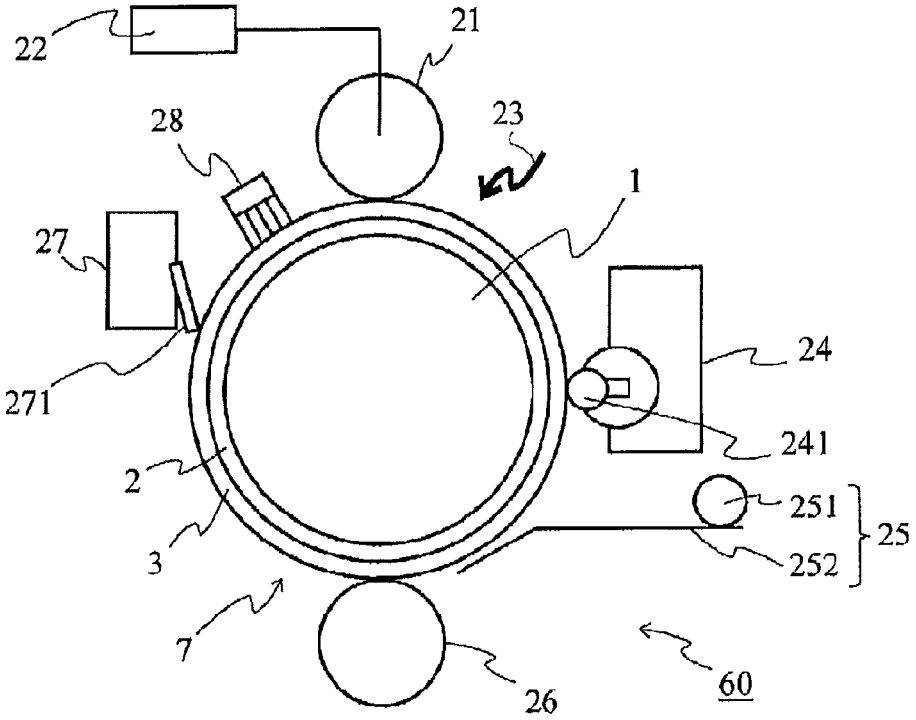
FIG. 2 illustrates a schematic diagram of an electrophotographic photoconductor according to the present invention.

As an example, FIG. 2 illustrates a schematic diagram of an electrophoto-graphic device according to the present invention. An electrophotographic device 60 of the present invention has installed therein the electrophotographic photoconductor 7 of the present invention, which comprises the conductive substrate 1, the undercoat layer 2 covering the outer peripheral face of the conductive substrate 1, and the photosensitive layer 3. The electrophotographic device 60 further comprises a roller charging member 21 disposed on the outer peripheral edge of the photoconductor 7; a high-voltage power source 22 that supplies application voltage to the roller charging member 21; an image exposure member 23; a developing device 24 provided with a developing roller 241; a paper feeding member 25 provided with a paper feeding roller 251 and a paper feeding guide 252; a transfer charging device (of direct charging type) 26; a cleaning device 27 provided with a cleaning thread 271; and a charge-removing member 28. The electrophotographic device 60 of the present invention can be used as a color printer.

EXAMPLES

The present invention is explained in detail below on the basis of examples, but is not limited to the below-described examples.

Example 1

Figure 3:
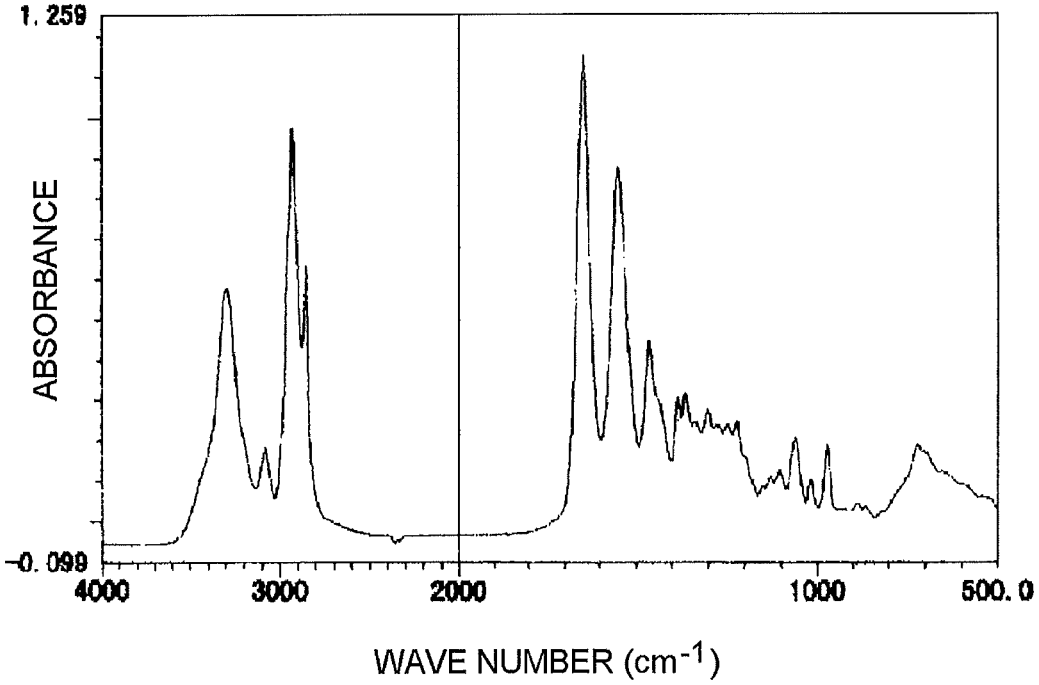
FIG. 3 is an infrared absorption spectrum of a resin obtained in Example 1.

As resin starting materials there were used 4 mol % of isophthalic acid, 46 mol % of dodecanedioic acid, and 50 mol % of isophorone diamine, which were adjusted to a total weight of 1 kg and were mixed in a 2,000 mL four-neck flask. The temperature in the reaction system was raised to 200° C. under a nitrogen stream, and the water component distilled out was collected. After 1 hour, the temperature was further raised to 300° C., and the polymerization reaction was left to proceed until no more water was distilled out, to obtain a resin of Example 1. FIG. 3 shows the infrared absorption spectrum of the resin.

Next, 0.5 g of the obtained resin was dissolved in 30 mL of methanol. Once dissolved, the resin was titrated with a 0.5 mol % KOH ethanol solution using phenolphthalein as an indicator. A blank test was conducted and then the acid value was calculated on the basis of the difference between the titration quantities in the sample and in the blank test.

Similarly, 0.5 g of the obtained resin were dissolved in 30 mL of methanol. Once dissolved, the resin was titrated with a 0.5 mol % HCl-ethanol solution using an indicator of thymol blue. A blank test was conducted and then the base value was calculated on the basis of the obtained titration quantities.

The resulting acid value of the obtained resin was 3.29 KOH mg/g, and the base value was 1.92 KOH mg/g.

The resin, in an amount of 100 parts by weight, was dissolved in 1200 parts by weight of ethanol and 800 parts by weight of tetrahydrofuran. A slurry was prepared then out of the resulting solution by adding thereto 400 parts by weight of titanium oxide that had been obtained by subjecting titanium oxide microparticles (JMT150), by Tayca Corporation, to a surface treatment using a surface treatment material comprising a 1/1 mixture of an aminosilane coupling agent (γ-aminopropyltriethoxysilane) and an isobutyl silane coupling agent (isobutyl trimethoxysilane). The acid value of the titanium oxide was 0.20 KOH mg/g, and the base value was 5.70 KOH mg/g. The obtained slurry was treated over 20 passes in a disk-type bead mill filled with zirconia beads having a bead diameter of 0.3 mm, at a volumetric filling factor of 80 v/v % with respect to the vessel capacity and at a flow rate of the treatment liquid of 300 mL/min and a disk circumferential speed of 4 m/s, to yield a undercoat layer coating solution (hereafter, also referred to as "UC solution").

An undercoat layer 2 was formed through dip coating of the prepared undercoat layer coating solution on a cylindrical aluminum substrate (conductive substrate) 1. After drying under conditions of drying temperature of 135° C. and drying time of 20 min there was obtained an undercoat layer 2 having a dried thickness of 1.5 μm.

Next, 1 part by weight of a polyvinyl butyral resin (Slec BM-1, by Sekisui Chemical) was dissolved in 98 parts by weight of dichloromethane. Then 2 parts by weight of an α-titanyl phthalocyanine disclosed in Japanese Patent Application Laid-open No. S61-217050 (or U.S. Pat. No. 4,728,592) were added to the resulting solution, to prepare 5 L of a slurry. The prepared 5 L of slurry were treated over 10 passes in a disk-type bead mill filled with zirconia beads having a bead diameter of 0.4 mm, at a volumetric filling factor of 85 v/v % with respect to the vessel capacity and at a flow rate of the treatment liquid of 300 mL/min and a disk circumferential speed of 3 m/s, to yield a charge generation layer coating solution.

A charge generation layer 4 was formed by applying the obtained charge generation layer coating solution onto the conductive substrate 1 that had been coated with the above-described undercoat layer 2. After drying under conditions of drying temperature of 80° C. and drying time of 30 min there was obtained a charge generation layer 4 having a dried thickness ranging from 0.1 to 0.5 μm.

Next, 5 parts by weight of the compound represented by structural formula (3) and 5 parts by weight of the compound represented by structural formula (4) below, as charge transport materials, and 10 parts by weight of a polycarbonate resin (Lupizeta PCZ-500, by Mitsubishi Gas Chemical), as a resin binder, were dissolved in 80 parts by weight of dichloromethane. Thereafter, 0.1 parts by weight of a silicone oil (KP-340, by Shin-Etsu Polymer), were added to the resulting solution to prepare a charge transport layer coating solution. The prepared charge transport layer coating solution was dip-coated onto the above-described charge generation layer 4, and was dried at 90° C. for 60 min, to form a 25 μm-thick charge transport layer 5, and prepare thereby an electrophotographic photoconductor 7.

Structural formula (3)

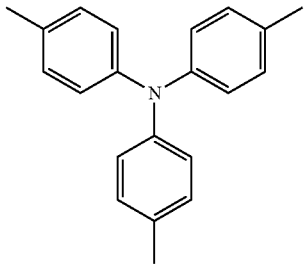

-continued

Structural formula (4)

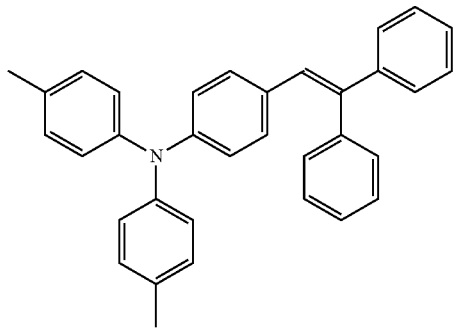

Example 2

A resin of Example 2 was obtained in the same way as in Example 1, except that herein the resin starting materials used were 2 mol % of isophthalic acid, 48 mol % of dodecanedioic acid and 50 mol % of isophorone diamine. The acid value of the obtained resin was 3.58 KOH mg/g, and the base value was 3.25 KOH mg/g. The resin was used in the same way as in Example 1 to prepare an undercoat layer coating solution, and to manufacture a photoconductor 7 in the same way as in Example 1.

Example 3

A resin of Example 3 was obtained in the same way as in Example 1, except that herein the resin starting materials used were 6 mol % of isophthalic acid, 44 mol % of dodecanedioic acid and 50 mol % of isophorone diamine. The acid value of the obtained resin was 3.35 KOH mg/g, and the base value was 2.78 KOH mg/g. The resin was used in the same way as in Example 1 to prepare an undercoat layer coating solution, and to manufacture a photoconductor 7 in the same way as in Example 1.

Example 4

A resin of Example 4 was obtained in the same way as in Example 1, except that herein the resin starting materials used were 0.1 mol % of isophthalic acid, 49.9 mol % of dodecanedioic acid and 50 mol % of isophorone diamine. The acid value of the obtained resin was 3.25 KOH mg/g, and the base value was 3.66 KOH mg/g. The resin was used in the same way as in Example 1 to prepare an undercoat layer coating solution, and to manufacture a photoconductor 7 in the same way as in Example 1.

Example 5

A resin of Example 5 was obtained in the same way as in Example 1, except that herein the resin starting materials used were 10 mol % of isophthalic acid, 40 mol % of dodecanedioic acid and 50 mol % of isophorone diamine. The acid value of the obtained resin was 4.25 KOH mg/g, and the base value was 4.38 KOH mg/g. The resin was used in the same way as in Example 1 to prepare an undercoat layer coating solution, and to manufacture a photoconductor 7 in the same way as in Example 1.

Example 6

A resin of Example 6 was obtained in the same way as in Example 1, except that herein the resin starting materials used were 4 mol % of isophthalic acid, 45.5 mol % of dodecanedioic acid and 50.5 mol % of isophorone diamine. The acid value of the obtained resin was 2.45 KOH mg/g, and the base value was 5.05 KOH mg/g. The resin was used in the same way as in Example 1 to prepare an undercoat layer coating solution, and to manufacture a photoconductor 7 in the same way as in Example 1.

Example 7

A resin of Example 7 was obtained in the same way as in Example 1, except that herein the resin starting materials used were 4 mol % of isophthalic acid, 45 mol % of dodecanedioic acid and 51 mol % of isophorone diamine. The acid value of the obtained resin was 1.82 KOH mg/g, and the base value was 6.10 KOH mg/g. The resin was used in the same way as in Example 1 to prepare an undercoat layer coating solution, and to manufacture a photoconductor 7 in the same way as in Example 1.

Example 8

A resin of Example 8 was obtained in the same way as in Example 1, except that herein the resin starting materials used were 4 mol % of isophthalic acid, 46.5 mol % of dodecanedioic acid and 49.5 mol % of isophorone diamine. The acid value of the obtained resin was 5.09 KOH mg/g, and the base value was 2.66 KOH mg/g. The resin was used in the same way as in Example 1 to prepare an undercoat layer coating solution, and to manufacture a photoconductor 7 in the same way as in Example 1.

Example 9

A resin of Example 9 was obtained in the same way as in Example 1, except that herein the resin starting materials used were 4 mol % of isophthalic acid, 47 mol % of dodecanedioic acid and 49 mol % of isophorone diamine. The acid value of the obtained resin was 6.20 KOH mg/g, and the base value was 1.51 KOH mg/g. The resin was used in the same way as in Example 1 to prepare an undercoat layer coating solution, and to manufacture a photoconductor 7 in the same way as in Example 1.

Example 10

An undercoat layer coating solution was prepared, in the same way as in Example 1, using a resin obtained in a case where the acid value was 10.0 KOH mg/g and the base value was 10.0 KOH mg/g at a polymerization stage during thermal polymerization of a mixture of the starting materials used in Example 1, to manufacture a photoconductor 7 in the same way as in Example 1.

Example 11

A resin of Example 11 was obtained in the same way as in Example 1, except that herein the resin starting materials used were 4 mol % of isophthalic acid, 23 mol % of dodecanedioic acid, 23 mol % of sebacic acid and 50 mol % of isophorone diamine. The acid value of the obtained resin was 3.45 KOH mg/g, and the base value was 2.96 KOH mg/g. The resin was used in the same way as in Example 1 to prepare an undercoat layer coating solution, and to manufacture a photoconductor 7 in the same way as in Example 1.

Example 12

A resin of Example 12 was obtained in the same way as in Example 1, except that herein the resin starting materials used were 4 mol % of isophthalic acid, 23 mol % of dodecanedioic acid, 23 mol % of sebacic acid, 25 mol % of isophorone diamine and 25 mol % of 1,4-diaminocyclohexane. The acid value of the obtained resin was 3.91 KOH mg/g, and the base value was 3.82 KOH mg/g. The resin was used in the same way as in Example 1 to prepare an undercoat layer coating solution, and to manufacture a photoconductor 7 in the same way as in Example 1.

Example 13

A resin of Example 13 was obtained in the same way as in Example 1, except that herein the resin starting materials used were 4 mol % of isophthalic acid, 46 mol % of sebacic acid and 50 mol % of isophorone diamine. The acid value of the obtained resin was 3.14 KOH mg/g, and the base value was 2.95 KOH mg/g. The resin was used in the same way as in Example 1 to prepare an undercoat layer coating solution, and to manufacture a photoconductor 7 in the same way as in Example 1.

Example 14

An undercoat layer coating solution was prepared in the same way as in Example 1, but herein the titanium oxide used in Example 1 was replaced by 400 parts by weight of titanium oxide that had been obtained by subjecting titanium oxide microparticles (JMT500), by Tayca Corporation, to a surface treatment using a surface treatment material comprising a 1/1 mixture of an aminosilane coupling agent and an isobutyl silane coupling agent, to manufacture a photoconductor 7. The acid value of the titanium oxide was 2.00 KOH mg/g, and the base value was 1.00 KOH mg/g.

Example 15

An undercoat layer coating solution was prepared in the same way as in Example 1, but herein the titanium oxide used in Example 1 was replaced by titanium oxide (SI-UFTR-Z), by Miyoshikasei, to manufacture a photoconductor 7. The acid value of the titanium oxide was 0.53 KOH mg/g, and the base value was 0.28 KOH mg/g.

Example 16

An undercoat layer coating solution was prepared in the same way as in Example 1, but herein the titanium oxide used in Example 1 was replaced by tin oxide obtained by treating tin oxide microparticles, by C. I. Kasei, with 1/1 of an aminosilane coupling agent and an isobutyl silane coupling agent, to manufacture a photoconductor 7. The acid value of the tin oxide was 5.00 KOH mg/g, and the base value was 5.70 KOH mg/g.

Example 17

An undercoat layer coating solution was prepared in the same way as in Example 1, but herein the charge generation material used in Example 1 was replaced by a titanyl phthalocyanine in the Y crystal form, to manufacture a photoconductor 7.

Example 18

An undercoat layer coating solution was prepared in the same way as in Example 1, but herein the charge generation material used in Example 1 was replaced by a metal-free phthalocyanine in the X crystal form, to manufacture a photoconductor 7.

Example 19

An undercoat layer coating solution was prepared in the same way as in Example 1, but herein the charge transport material used in Example 1 was replaced by 10 parts by weight a compound represented by structural formula (5) below, to manufacture a photoconductor 7.

Structural formula (5)

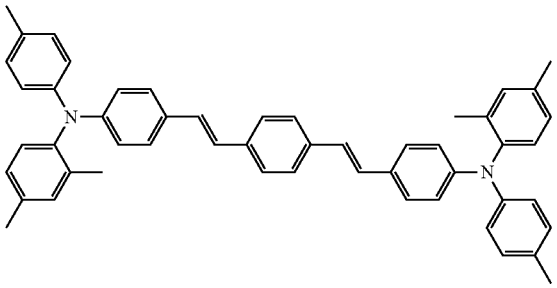

Example 20

An undercoat layer coating solution was prepared in the same way as in Example 1, but herein the charge transport material used in Example 17 was replaced by 10 parts by weight a compound represented by structural formula (5) above, to manufacture a photoconductor 7.

Comparative Example 1

A resin of Comparative example 1 was obtained in the same way as in Example 1, except that herein the resin starting materials used were 12 mol % of isophthalic acid, 38 mol % of dodecanedioic acid and 50 mol % of isophorone diamine. The acid value of the obtained resin was 4.20 KOH mg/g, and the base value was 4.50 KOH mg/g. The resin was used in the same way as in Example 1 to prepare an undercoat layer coating solution, and to manufacture a photoconductor in the same way as in Example 1.

Comparative Example 2

A resin of Comparative example 2 was obtained in the same way as in Example 1, except that herein the resin starting materials used were 4 mol % of isophthalic acid, 47.5 mol % of dodecanedioic acid and 48.5 mol % of isophorone diamine. The acid value of the obtained resin was 10.20 KOH mg/g, and the base value was 0.01 KOH mg/g. The resin was used in the same way as in Example 1 to prepare an undercoat layer coating solution, and to manufacture a photoconductor in the same way as in Example 1.

Comparative Example 3

A resin of Comparative example 3 was obtained in the same way as in Example 1, except that herein the resin starting materials used were 4 mol % of isophthalic acid, 49 mol % of dodecanedioic acid and 47 mol % of isophorone diamine. The acid value of the obtained resin was 12.1 KOH mg/g, and the base value was 0.02 KOH mg/g. The resin was used in the same way as in Example 1 to prepare an undercoat layer coating solution, and to manufacture a photoconductor in the same way as in Example 1.

Comparative Example 4

A resin of Comparative example 4 was obtained in the same way as in Example 1, except that herein the resin starting materials used were 4 mol % of isophthalic acid, 44.5 mol % of dodecanedioic acid and 51.5 mol % of isophorone diamine. The acid value of the obtained resin was 0.02 KOH mg/g, and the base value was 10.28 KOH mg/g. The resin was used in the same way as in Example 1 to prepare an undercoat layer coating solution, and to manufacture a photoconductor in the same way as in Example 1.

Comparative Example 5

A resin of Comparative example 5 was obtained in the same way as in Example 1, except that herein the resin starting materials used were 4 mol % of isophthalic acid, 43 mol % of dodecanedioic acid and 53 mol % of isophorone diamine. The acid value of the obtained resin was 0.01 KOH mg/g, and the base value was 12.9 KOH mg/g. The resin was used in the same way as in Example 1 to prepare an undercoat layer coating solution, and to manufacture a photoconductor in the same way as in Example 1.

Comparative Example 6

An undercoat layer coating solution was prepared in the same way as in Comparative example 1, but herein the titanium oxide used in Comparative example 1 was replaced by the titanium oxide used in Example 14, to prepare a photoconductor.

Comparative Example 7

An undercoat layer coating solution was prepared in the same way as in Comparative example 1, but herein the titanium oxide used in Comparative example 1 was replaced by the titanium oxide used in Example 15, to prepare a photoconductor.

Comparative Example 8

An undercoat layer coating solution was prepared in the same way as in Comparative example 1, but herein the titanium oxide used in Comparative example 1 was replaced by the tin oxide used in Example 16, to prepare a photoconductor.

Comparative Example 9

A undercoat layer coating solution was prepared in the same way as in Example 1, but using herein, as a resin starting material, the resin (having an acid value of 2.11 KOH mg/g and a base value of 1.56 KOH mg/g) disclosed in Example 1 of Japanese Patent Application Laid-open No. 2007-178660 (or US Patent No. 2007/154827), and to manufacture a photoconductor in the same way as in Example 1.

Comparative Example 10

A resin of Comparative example 10 was obtained in the same way as in Example 1, except that herein the resin starting materials used were 4 mol % of isophthalic acid, 46 mol % of adipic acid and 50 mol % of isophorone diamine. The acid value of the obtained resin was 2.32 KOH mg/g, and the base value was 2.46 KOH mg/g. The resin was used in the same way as in Example 1 to prepare an undercoat layer coating solution, and to manufacture a photoconductor in the same way as in Example 1.

Comparative Example 11

A resin of Comparative example 11 was obtained in the same way as in Example 1, except that herein the resin starting materials used were 4 mol % of isophthalic acid, 46 mol % of dodecanedioic acid and 50 mol % of hexamethylenediamine. The acid value of the obtained resin was 3.28 KOH mg/g, and the base value was 3.55 KOH mg/g. The resin was used in the same way as in Example 1 to prepare an undercoat layer coating solution, and to manufacture a photoconductor in the same way as in Example 1.

Comparative Example 12

A resin of Comparative example 12 was obtained in the same way as in Example 1, except that herein the resin starting materials used were 4 mol % of isophthalic acid, 36 mol % of dodecanedioic acid, 40 mol % of isophorone diamine and 20 mol % of ϵ-caprolactam. The acid value of the obtained resin was 3.28 KOH mg/g, and the base value was 3.55 KOH mg/g. The resin was used in the same way as in Example 1 to prepare an undercoat layer coating solution, and to manufacture a photoconductor in the same way as in Example 1.

Comparative Example 13

An undercoat layer coating solution was prepared in the same way as in Comparative example 1, but herein the resin used in Comparative example 1 was replaced by Amilan CM8000, by Toray, to prepare a photoconductor.

The photoconductors obtained in Examples 1 to 20 and Comparative examples 1 to 13 were fitted to a commercially available printer (CLP300 by Samsung) and image quality was evaluated under various environments (high temperature and high humidity 35° C., 85% RH; normal temperature and normal humidity 25° C., 50% RH; and low temperature and low humidity 5° C., 15% RH). For image data evaluation, images obtained using photoconductors having substantially identical electric characteristics were evaluated on the basis of the presence or absence of black spots and ground fogging in white portions of the image. Further, memory between paper sheets caused by transfer influence was assessed based on the transfer influence between a first paper sheet and a second paper sheet, i.e. based on whether a portion between sheets exhibited a halftone density difference on the halftone of the second sheet when using a halftone image on the second sheet.

Assessment of memory between sheets:

⊗ : Very good level, no memory observed.

o: Very slight memory level, not problematic in practice.

X: Distinctly appreciable memory level.

Figure 4:
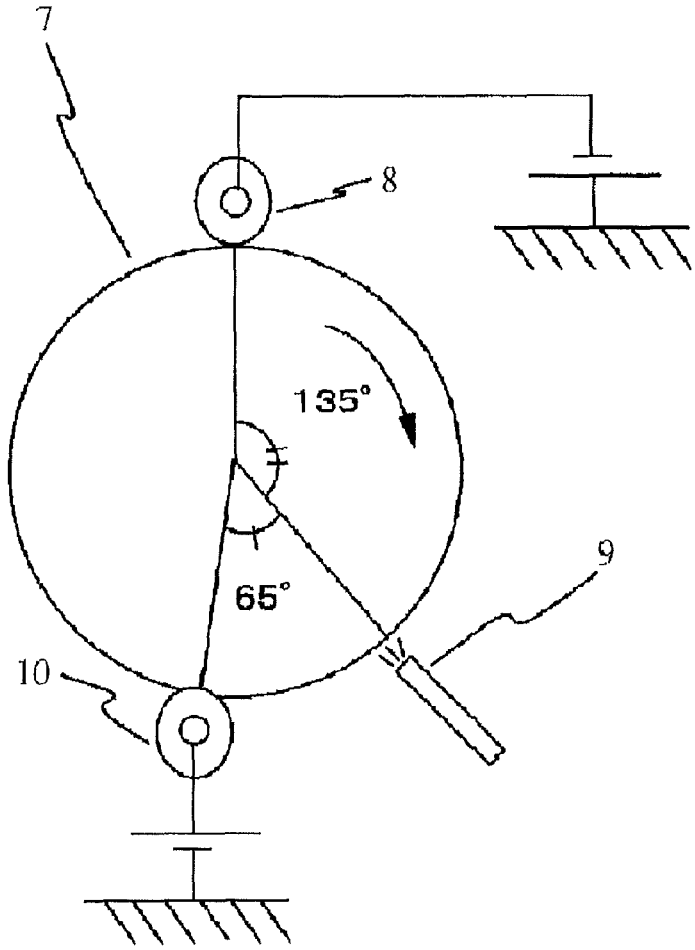
FIG. 4 is a cross-sectional diagram of an electrophotographic device used for evaluating charging potential differences.

The various photoconductors are used in a characteristic measurement system for photosensitive drums, CYNTHIA 91 by Gentec, and the photoconductor 7, a charging roller 8, an electrometer 9 and a transfer roller 10 are disposed in accordance with the arrangement in the cross-sectional diagram of an electrophotographic device illustrated in FIG. 4.

The photoconductor 7, charged at −600 V, is rotated in the direction of the arrow in FIG. 4 at a circumferential speed of 100 mm/s. The photoconductor 7 is rotated 3 times at a transfer voltage of 0 kV, then 3 times at a transfer voltage raised to 0.2 kV, after which the transfer voltage is raised by 0.2 kV every 3 rotations, up to 1.2 kV. The degree of transfer influence was measured by measuring the charging potential difference between the charging potential of the photoconductor at a time of transfer voltage 0 kV, and by measuring the periodic charging potential immediately after application of a 1.2 kV transfer voltage. The results are given in Tables 1 to 4 below. Transfer memory between sheets becomes visually appreciable, and hence problematic, at a charging potential difference of 40V or greater.

TABLE 1

| | Resin characteristics | | | | | | |
|---|---|---|---|---|---|---|---|
| | Aromatic dicarboxylic acid | Dicarboxylic acid having ≥8 carbon atoms | Diamine having a cycloalkane structure | A − B | Resin acid value | Resin base value | Resin component characteristics |
| | mol % | | | | KOH mg/g | | |
| Example 1 | 4 | 46 | 50 | 0 | 3.29 | 1.92 | Within scope of invention |
| Example 2 | 2 | 48 | 50 | 0 | 3.58 | 3.25 | Within scope of invention |
| Example 3 | 6 | 44 | 50 | 0 | 3.35 | 2.78 | Within scope of invention |
| Example 4 | 0.1 | 49.9 | 50 | 0 | 3.25 | 3.66 | Within scope of invention |
| Example 5 | 10 | 40 | 50 | 0 | 4.25 | 4.38 | Within scope of invention |
| Example 6 | 4 | 45.5 | 50.5 | −1 | 2.45 | 5.05 | Within scope of invention |
| Example 7 | 4 | 45 | 51 | −2 | 1.82 | 6.10 | Within scope of invention |
| Example 8 | 4 | 46.5 | 49.5 | 1 | 5.09 | 2.66 | Within scope of invention |
| Example 9 | 4 | 47 | 49 | 2 | 6.20 | 1.51 | Within scope of invention |
| Example 10 | 4 | 46 | 50 | 0 | 10.00 | 10.00 | Within scope of invention |
| Example 11 | 4 | 46 | 50 | 0 | 3.45 | 2.96 | Within scope of invention |
| Example 12 | 4 | 46 | 50 | 0 | 3.91 | 3.82 | Within scope of invention |
| Example 13 | 4 | 46 | 50 | 0 | 3.14 | 2.95 | Within scope of invention |
| Example 14 | 4 | 46 | 50 | 0 | 3.29 | 1.92 | Within scope of invention |
| Example 15 | 4 | 46 | 50 | 0 | 3.29 | 1.92 | Within scope of invention |
| Example 16 | 4 | 46 | 50 | 0 | 3.29 | 1.92 | Within scope of invention |
| Example 17 | 4 | 46 | 50 | 0 | 3.29 | 1.92 | Within scope of invention |
| Example 18 | 4 | 46 | 50 | 0 | 3.29 | 1.92 | Within scope of invention |
| Example 19 | 4 | 46 | 50 | 0 | 3.29 | 1.92 | Within scope of invention |
| Example 20 | 4 | 46 | 50 | 0 | 3.29 | 1.92 | Within scope of invention |

TABLE 2

| | Resin characteristics | | | | | | |
|---|---|---|---|---|---|---|---|
| | Aromatic dicarboxylic acid | Dicarboxylic acid having ≥8 carbon atoms | Diamine having a cycloalkane structure | A − B | Resin acid value | Resin base value | Resin component characteristics |
| | mol % | | | | KOH mg/g | | |
| Comparative example 1 | 12 | 38 | 50 | 0 | 4.20 | 4.50 | Equal to or greater than isophthalic acid upper limit |
| Comparative example 2 | 4 | 47.5 | 48.5 | 3 | 10.20 | 0.01 | Exceeds A − B upper limit |
| Comparative example 3 | 4 | 49 | 47 | 6 | 12.10 | 0.02 | Exceeds A − B upper limit |
| Comparative example 4 | 4 | 44.5 | 51.5 | −3 | 0.02 | 10.28 | Exceeds A − B lower limit |
| Comparative example 5 | 4 | 43 | 53 | −6 | 0.01 | 12.90 | Exceeds A − B lower limit |

TABLE 2-continued

| | Resin characteristics | | | | | | |
|---|---|---|---|---|---|---|---|
| | Aromatic dicarboxylic acid | Dicarboxylic acid having ≥8 carbon atoms | Diamine having a cycloalkane structure | A − B | Resin acid value | Resin base value | Resin component characteristics |
| | mol % | | | | KOH mg/g | | |
| Comparative example 6 | 12 | 38 | 50 | 0 | 4.20 | 4.50 | Equal to or greater than isophthalic acid upper limit |
| Comparative example 7 | 12 | 38 | 50 | 0 | 4.20 | 4.50 | Equal to or greater than isophthalic acid upper limit |
| Comparative example 8 | 12 | 38 | 50 | 0 | 4.20 | 4.50 | Equal to or greater than isophthalic acid upper limit |
| Comparative example 9 | 4 | 25 | 25 | 4 | 2.11 | 1.56 | Contains dicarboxylic acid having <8 carbon atoms; exceeds A − B upper limit |
| Comparative example 10 | 4 | 0 | 50 | −46 | 2.32 | 2.46 | Contains dicarboxylic acid having <8 carbon atoms; exceeds A − B lower limit |
| Comparative example 11 | 4 | 46 | 0 | 50 | 3.28 | 3.55 | Diamine lacking cycloalkane structure, exceeds A − B upper limit |
| Comparative example 12 | 4 | 36 | 40 | 0 | 4.07 | 3.93 | Cyclic amide compound added |
| Comparative example 13 | — | — | — | — | 2.20 | 1.98 | CM8000 (no aromatics) |

TABLE 3

| | | Environment image characteristic evaluation results | | | Transfer performance | |
|---|---|---|---|---|---|---|
| | UC solution change over time | Image in 35° C., 85% RH environment | Image in 25° C., 50% RH environment | Image in 5° C., 15% RH environment | Memory between sheets | Charging potential difference ΔVo(V) between transfer voltage 1.2 kV and no transfer voltage |
| Example 1 | None | Good | Good | Good | ⊗ | 12 |
| Example 2 | None | Good | Good | Good | ⊗ | 15 |
| Example 3 | None | Good | Good | Good | ⊗ | 16 |
| Example 4 | None | Good | Good | Good | ⊗ | 24 |
| Example 4 | None | Good | Good | Good | ⊗ | 24 |
| Example 5 | None | Good | Good | Good | ⊗ | 22 |
| Example 6 | None | Good | Good | Good | ⊗ | 26 |
| Example 7 | None | Good | Good | Good | ○ | 31 |
| Example 8 | None | Good | Good | Good | ○ | 26 |
| Example 9 | None | Good | Good | Good | ○ | 32 |
| Example 10 | None | Good | Good | Good | ○ | 36 |
| Example 11 | None | Good | Good | Good | ⊗ | 23 |
| Example 12 | None | Good | Good | Good | ⊗ | 25 |
| Example 13 | None | Good | Good | Good | ○ | 37 |
| Example 14 | None | Good | Good | Good | ⊗ | 25 |
| Example 15 | None | Good | Good | Good | ⊗ | 12 |
| Example 16 | None | Good | Good | Good | ○ | 26 |
| Example 17 | None | Good | Good | Good | ⊗ | 12 |
| Example 18 | None | Good | Good | Good | ⊗ | 18 |
| Example 19 | None | Good | Good | Good | ⊗ | 12 |
| Example 20 | None | Good | Good | Good | ⊗ | 16 |

TABLE 4

| | | Environment image characteristic evaluation results | | | Transfer performance | |
|---|---|---|---|---|---|---|
| | UC solution change over time | Image in 35° C., 85% RH environment | Image in 25° C., 50% RH environment | Image in 5° C., 15% RH environment | Memory between sheets | Charging potential difference ΔVo(V) between transfer voltage 1.2 kV and no transfer voltage |
| Comparative example 1 | Aggregation/ precipitation | Fogging, black spots | Black spots | Black spots | X | 75 |
| Comparative example 2 | Aggregation/ precipitation | Fogging, black spots | Black spots | Black spots | X | 53 |
| Comparative example 3 | Aggregation/ precipitation | Fogging, black spots | Fogging, black spots | Black spots | X | 65 |
| Comparative example 4 | Aggregation/ precipitation | Fogging, black spots | Fogging, black spots | Black spots | X | 51 |
| Comparative example 5 | Aggregation/ precipitation | Fogging, black spots | Fogging, black spots | Black spots | X | 69 |
| Comparative example 6 | Aggregation/ precipitation | Fogging, black spots | Fogging, black spots | Black spots | X | 74 |
| Comparative example 7 | Aggregation/ precipitation | Fogging, black spots | Fogging, black spots | Black spots | X | 77 |
| Comparative example 8 | Aggregation/ precipitation | Fogging, black spots | Fogging, black spots | Black spots | X | 72 |
| Comparative example 9 | None | Good | Good | Good | X | 49 |
| Comparative example 10 | None | Good | Good | Good | X | 61 |
| Comparative example 11 | None | Good | Good | Good | X | 65 |
| Comparative example 12 | None | Good | Good | Good | X | 62 |
| Comparative example 13 | None | Fogging, black spots | Good | Exposure memory | X | 88 |

As Tables 1 to 4 show, coating solution stability was good in the UC solutions of all the examples, where there were used resins polymerized using isophthalic acid, adipic acid and sebacic acid, as well as hexamethylenediamine and isophorone diamine as starting materials, at a predetermined mol % amount range of isophthalic acid, on an undercoat layer. The image characteristics of the photoconductors 7 of the examples was good under various environments. No transfer-derived image memory was observed, and potential fluctuation was small, no greater than 40 V. A comparison between Example 1 (dodecanedioic acid having 12 carbon atoms), Example 13 (sebacic acid having 8 carbon atoms) and Comparative example 10 (adipic acid having 6 carbon atoms) reveals that transfer performance is particularly high for dodecanedioic acid, from among the aliphatic dicarboxylic acids.

By contrast, dispersibility was poor, and image characteristics problematic, for the photoconductors of Comparative examples 1 and 6 to 8, having a high content of isophthalic acid in the starting materials, for the photoconductors of Comparative examples 2 and 3, having a high acid value, with the A−B value of formula (1) outside the range, and for the photoconductors of Comparative examples 4 and 5, having a high base value, with the A−B value outside the range. The photoconductor of Comparative example 13, which uses a general-purpose resin that contains no aromatic component, exhibits image black spots in particular in a high-temperature high-humidity environment. This indicates that such problems may occur depending on the type and on the blending amount of metal oxide that is combined with the resin, in cases of highly hygroscopic resins.

When using constituent monomers in the form of a dicarboxylic acid having fewer than 8 carbon atoms, or a diamine lacking a cycloalkane structure, or a cyclic amide compound, as in Comparative examples 9 to 12, the environment image characteristics are comparatively good, thanks to the presence of aromatic component, but transfer performance is insufficient. All the comparative examples, where the potential fluctuation is 40 V or higher, exhibit transfer memory between sheets.

The results indicate that using the resin of the present invention results in good image characteristics under various environments, and in enhanced transfer characteristics.ps

The invention claimed is:

1. An electrophotographic photoconductor, comprising:

a conductive substrate;

an undercoat layer provided on the conductive substrate and consisting of:

from 5 to 80 parts by weight, based on 100 parts by weight of a solids fraction in the undercoat layer, of a resin that has an acid value and a base value that are each no greater than 10 KOH mg/g and that is obtained by polymerizing starting materials consisting of from 0.1 to 10 mol % of one type of aromatic dicarboxylic acid, at least one type of aliphatic dicarboxylic acid having 8 or more carbon atoms, and at least one type of diamine having a cycloalkane structure; and from 95 to 20 parts by weight, based on 100 parts by weight of a solids fraction in the undercoat layer, of at least one metal oxide that has an acid value and a base value that are each no greater than 20.0 KOH mg/g so that the at least one metal oxide is effectively dispersed in said resin; and a photosensitive layer provided on the undercoat layer so that a sequential stack is obtained.

2. The electrophotographic photoconductor according to claim 1, wherein said resin is obtained through mixing and polymerization so as to satisfy formula (1) that follows:

$$-2.0 \text{ mol } \% \leq A-B \leq 2.0 \text{ mol } \% \quad (1),$$

where A mol % denotes the sum of said aromatic dicarboxylic acid and said at least one type of aliphatic dicarboxylic acid having 8 or more carbon atoms, and B mol % denotes the sum of at least one type of diamine having a cycloalkane structure.

3. An electrophotographic photoconductor, comprising:

a conductive substrate;

an undercoat layer provided on the conductive substrate and consisting of:

from 5 to 80 parts by weight, based on 100 parts by weight of a solids fraction in the undercoat layer, of a resin that has an acid value and a base value that are each no greater than 10 KOH mg/g and that is obtained by polymerizing starting materials consisting of from 0.1 to 10 mol % of one type of aromatic dicarboxylic acid, one type of aliphatic dicarboxylic acid having 8 or more carbon atoms, and one type of diamine having a cycloalkane structure; and from 95 to 20 parts by weight, based on 100 parts by weight of a solids fraction in the undercoat layer, of at least one metal oxide that has an acid value and a base value that are each no greater than 20.0 KOH mg/g so that the at least one metal oxide is effectively dispersed in said resin; and a photosensitive layer provided on the undercoat layer so that a sequential stack is obtained.

4. The electrophotographic photoconductor according to claim 3, wherein said resin is obtained through mixing and polymerization so as to satisfy formula (1) that follows:

$$-2.0 \text{ mol } \% \leq A - B \leq 2.0 \text{ mol } \% \quad (1),$$

where A mol % denotes the sum of said aromatic dicarboxylic acid and said one type of aliphatic dicarboxylic acid having 8 or more carbon atoms, and B mol % denotes the amount of said one type of diamine having a cycloalkane structure.

5. The electrophotographic photoconductor according to claim 1, wherein said aromatic dicarboxylic acid has a structure represented by general formula (2) that follows:

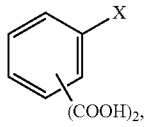

(2)

where X denotes a hydrogen atom, an alkyl group, an allyl group, a halogen atom, an alkoxy group or an aryl group.

6. The electrophotographic photoconductor according to claim 5, wherein said aromatic dicarboxylic acid is at least one aromatic dicarboxylic acid selected from the group consisting of isophthalic acid, phthalic acid and terephthalic acid.

7. The electrophotographic photoconductor according to claim 1, wherein said at least one type of aliphatic dicarboxylic acid having 8 or more carbon atoms includes at least one aliphatic dicarboxylic acid selected from the group consisting of dodecanedioic acid, undecanedioic acid, sebacic acid and tridecanedioic acid.

8. The electrophotographic photoconductor according to claim 1, wherein said at least one type of diamine includes isophorone diamine.

9. The electrophotographic photoconductor according to claim 1, wherein said at least one metal oxide is selected from the group consisting of simple metal oxides of titanium oxide, zinc oxide, tin oxide, zirconium oxide, silicon oxide, copper oxide, magnesium oxide, antimony oxide, vanadium oxide, yttrium oxide and niobium oxide, and complex metal oxides of these metal oxides.

10. The electrophotographic photoconductor according to claim 9, wherein said at least one metal oxide has a treated surface due to having been subjected to a surface treatment.

11. The electrophotographic photoconductor according to claim 10, wherein said at least one metal oxide is titanium oxide and has a treated surface due to having been subjected to a surface treatment.

12. The electrophotographic photoconductor according to claim 1, wherein the photosensitive layer includes a charge generation material that is at least one type of charge generation material selected from the group consisting of titanyl phthalocyanine and metal-free phthalocyanines.

13. The electrophotographic photoconductor according to claim 1, wherein said photosensitive layer is a stack including a charge generation layer and a charge transport layer.

14. The electrophotographic photoconductor according to claim 1, wherein said photosensitive layer is a single layer containing a charge generation material and a charge transport material.

15. A method for manufacturing the electrophotographic photoconductor according to claim 1, comprising:

forming said undercoat layer by applying a coating solution for undercoat layers on said conductive substrate, wherein said coating solution contains, as a main component, said resin, and further contains said metal oxide.

16. An electrophotographic device comprising the electrophotographic photoconductor according to claim 1.

17. The electrophotographic device according to claim 16, wherein the electrophotographic device is a color printer.

18. The electrophotographic photoconductor according to claim 3, wherein said aromatic dicarboxylic acid has a structure represented by general formula (2) that follows:

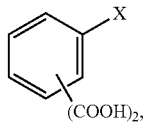

(2)

where X denotes a hydrogen atom, an alkyl group, an allyl group, a halogen atom, an alkoxy group or an aryl group.

19. An electrophotographic device comprising the electrophotographic photoconductor according to claim 3.

20. The electrophotographic device according to claim 19, wherein the electrophotographic device is a color printer.

* * * * *